US006397438B1

(12) United States Patent
DeWan

(10) Patent No.: US 6,397,438 B1
(45) Date of Patent: Jun. 4, 2002

(54) EMBEDDED HOOK AND LOOP FASTENER

(76) Inventor: Thomas E. DeWan, 3200 Bayou Placido Blvd., NE., St. Petersburg, FL (US) 33703

( * ) Notice: Subject to any disclaimer, the term of this patent is extended or adjusted under 35 U.S.C. 154(b) by 0 days.

(21) Appl. No.: 09/669,713

(22) Filed: Sep. 26, 2000

(51) Int. Cl.[7] ..... A44B 18/00; A47K 5/08

(52) U.S. Cl. ..... 24/306; 24/17 AP; 24/442; 224/202

(58) Field of Search ..... 24/306, 442, 17 AP

(56) References Cited

U.S. PATENT DOCUMENTS

| | | | | | |
|---|---|---|---|---|---|
| 3,000,384 | A | * | 9/1961 | Piers, Jr. | 24/17 AP |
| 3,160,523 | A | | 12/1964 | Hull | |
| 3,315,933 | A | | 4/1967 | Tatham | |
| 3,796,665 | A | | 3/1974 | Allen | |
| 4,034,851 | A | * | 7/1977 | Barksdale | 206/77.1 |
| 4,741,852 | A | | 5/1988 | Ondracek | |
| 4,831,997 | A | * | 5/1989 | Greene | 24/306 |
| 4,858,801 | A | * | 8/1989 | Sameniego | 24/306 |
| 4,939,818 | A | * | 7/1990 | Hahn | 24/442 |
| 4,969,225 | A | * | 11/1990 | Schubert | 15/209 C |
| 5,048,158 | A | * | 9/1991 | Koerner | 24/17 AP |
| 5,242,063 | A | * | 9/1993 | Ericksen et al. | 211/87 |
| 5,366,125 | A | * | 11/1994 | Procido | 224/202 |
| 5,642,871 | A | | 7/1997 | Repert et al. | |

FOREIGN PATENT DOCUMENTS

| | | | | |
|---|---|---|---|---|
| GB | 1208140 | * | 10/1970 | 24/306 |

* cited by examiner

*Primary Examiner*—Victor N. Sakran
(74) *Attorney, Agent, or Firm*—Andrew M. Hill

(57) ABSTRACT

A strip of hook and loop fastening material embedded within an article having a body such as a bar of soap. In alternative embodiments, the strip has one embedded end and one free end, or alternatively both ends are embedded to form a loop serving as a handle. Preferably, the strip of hook and loop material has holes, or alternatively, the edges of the strip of hook and loop material are pinked, to increase surface area for improving retention of the strip by the body. Alternatively, the strip may have negative taper wherein the relatively wide end is embedded, or the embedded portion may form a serpentine path. Alternatively, two strips of hook and loop material, preferably overlapping, are embedded within the article. The article includes an anchoring member bearing complementary hook and loop material on one side and adhesive on the other side. The article is formed by casting constituent material of the body in fluent form in a mold wherein part of the strip of hook and loop fastener projects outwardly from the mold.

17 Claims, 3 Drawing Sheets

EMBEDDED HOOK AND LOOP FASTENER

BACKGROUND OF THE INVENTION

1. Field of the Invention

The present invention relates to apparatus for and method of releasably supporting an article to a supporting environmental surface by hook and loop fastener. More particularly, one or more strips of hook and loop fastener is embedded in and projects from the article being supported.

2. Description of the Prior Art

Many objects and depletable substances are preferably stored exposed in a convenient place. If the objects and substances are not subject to contamination by exposure to air, then they may suspended from an environmental surface by a tether embedded in the object or substance. Such arrangements are known, wherein the tether is a rope, or includes complicating structure such as knots, snaps, and other arrangements for engaging a cooperating attachment device, such as a hook.

U.S. Pat. No. 5,642,871, issued to Bruce Repert et al. on Jul. 1, 1997, is directed to a suspendable soap holder. The soap holder comprises a buoyant body to which is attached a suspender in the form of a loop, for attaching the soap to a hook mounted to an environmental surface. The buoyant body also incorporates one member of mutually attracting devices. The other member of the mutually attracting devices is embedded within the bar of soap. In the preferred embodiment, the mutually attracting devices operate magnetically such that the bar of soap is attracted to the buoyant body. Repert et al. acknowledges that hook and loop material, as well as other specified two-part connectors, could be substituted for the magnet. However, no specific arrangement of hook and loop material is either shown or described.

U.S. Pat. No. 3,160,523, issued to William D. Hull on Dec. 8, 1964, and U.S. Pat. No. 3,796,665, issued to Levi G. Allen on Mar. 12, 1974, illustrate rope or similar cords embedded within and projecting from bars of soap. There is no suggestion of using hook and loop material in either patent.

U.S. Pat. No. 4,741,852, issued to John Ondracek on May 3, 1988, describes a soap bar wherein a sheet of fabric is embedded therein and projects therefrom. The fabric is unrelated to attachment of the bar of soap to an environmental surface.

U.S. Pat. No. 3,315,933, issued to Charles H. Tatham on Apr. 25, 1967, describes structure for supporting a cake of soap from a rod. A thimble shaped liner which receives the end of the rod is cast into the soap, as well as an opening affording access to the liner. Tatham discusses desirability of suspending soap in a manner promoting rapid drying, but fails to suggest the use of hook and loop material to accomplish his stated end.

None of the above inventions and patents, taken either singly or in combination, is seen to describe the instant invention as claimed.

SUMMARY OF THE INVENTION

The present invention provides readily fabricated, secure, convenient mounting for diverse articles. This mounting is particularly suitable for depletable substances such as bars of hand soap. Other examples of depletable substances include solid forms impregnated with substances which are intended to be slowly or progressively dispensed or disseminated into a fluid medium or to an animal or person, such as fertilizer, colorants, medicaments, sweeteners, nutrients, chemical reactants, odorants and deodorants, and bactericides, to name a random few. One or more strips of hook and loop fastener is embedded within the substance. Each strip projects from the article, and can be readily and removably attached to a complementary patch of hook and loop material which is permanently fastened in a desired location to an environmental surface. Alternatively, two strips be embedded in and project from the substance, so that the two straps can be fastened to one another to form an openable loop.

Advantages of this uncomplicated arrangement go well beyond those available from seemingly similar arrangements. A significant advantage is that the material of the suspended article which surrounds the hook and loop strip need not touch any other environmental object. Thus this article can be suspended without scratching, depositing some material on, or otherwise marring or fouling an environmental surface. Bars of hand soap, for example, can be suspended and allowed to dry. No soap flows onto an environmental surface such as sinks, bathtubs, and others, to mar the environmental surface and to hasten depletion of the soap. Another advantage is that the environmental surface supporting the article need not be penetrated or damaged such as by drilling, driving a fastener, and the like. Also, the complementing patch of hook and loop material does not project outwardly from the supporting surface as does other attachment structure such as hooks.

Unlike fasteners such as snaps, fastening can proceed without demanding precise alignment of, for example, one snap with another, encirclement of a potentially small hook, and of other structure. Still another advantage is that minor adjustment of position of the suspended article is possible by adjusting position of the exposed strip of hook and loop material relative to the complementing patch permanently fixed to the environmental surface. Therefore, several articles can be suspended in close proximity and adjusted to assure that one will not contact an adjacent article.

Another benefit of the novel arrangement is that the strip of hook and loop material can form a loop wherein both ends of the strip are embedded within the article. Thus the user has two available ways of suspending the article. One is by engagement of a projection such as a hook, and the other is by contact with complementing hook and loop material. The loop can further serve as a handle for wielding the article.

Articles which benefit by the novel arrangement include those with tacky or wet surfaces, or which could transfer constituent material to an environmental surface. Bar soap can be suspended so that the entire exterior surface is exposed to air, thereby drying without depositing fluid or dissolved soap on hard surfaces. Articles intended to discharge volatile substances to the air, such as perfumes, can maximize exposed surface area, and hence rate of discharge, relative to their total surface area.

The nature of hook and loop material promotes retention and conservation of solid or bar soap. Soap becomes entrapped within the individual hook or loop members, and is retained. When wetted, the strip of hook and loop material provides the function of a scrubbing device saturated with soap. Therefore, the soap is fully utilized. This function is not satisfactorily achieved by ropes.

In some usages, incidental contact with an environmental surface and loss of some constituent material is acceptable, but it is strongly desired to catch that material which is lost. For example, a bar of soap may be suspended from an interior surface of a waste sink or a soap receptacle, so that drippage from the bar is not objectionable. Alternatively, the bar of soap may be suspended on an outside surface of a sink.

A method of fabricating an article according to the invention includes the step of leaving at least part of the strip of hook and loop material exposed to air while the constituent material is poured in fluid form around one or two ends o f the s trip of hook and loop material.

Accordingly, it is one object of the invention to provide ready, removable fastening of an article to an environmental surface.

It is another object of the invention to avoid contacting and marring an environmental surface by an article capable of transferring some constituent material to the environmental surface.

It is a further object of the invention to maximize rate of drying of wet articles due to exposure to air.

Still another object of the invention is to maximize rate of discharge of volatile substances from solid carriers due to exposure to air.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
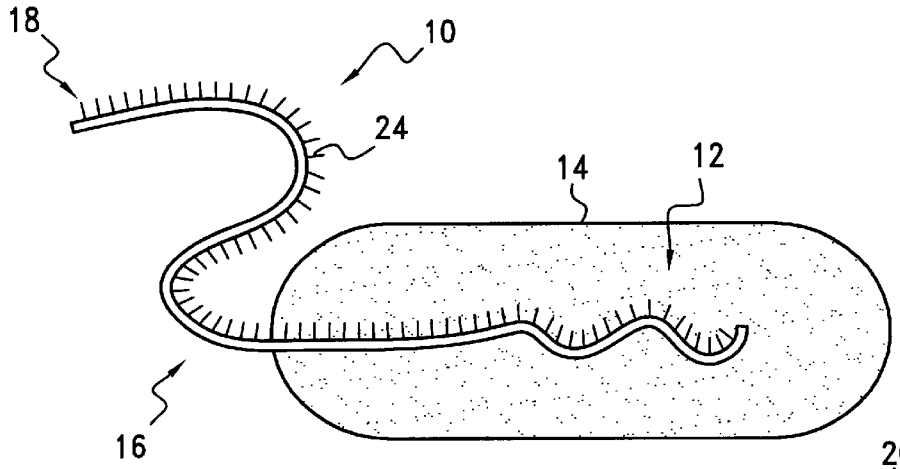
FIG. 1 is a side cross sectional view of one embodiment of the invention.

FIG. 1 of the drawings shows an article having a projecting fastener, the fastener comprising a strip 10 of elastic or non-elastic hook and loop fastening material. As employed herein, hook and loop fastening material will be taken in its generic sense in that only hooks or only loops will be provided on any one piece of hook and loop material. Strip 10 has a first end 12 embedded within a solid body 14. Body 14 is preferably formed from a constituent material which is progressively depleted with use. In the preferred embodiment, this material is solid soap which has been cast when in fluent form over first end 12 and allowed to dry or harden. Strip 10 is seen to have an embedded portion (i.e., end 12) and an exposed portion 16 spaced apart from body 14. In the example of FIG. 1, the second end 18 of strip 10 is part of exposed portion 16.

Figure 2:
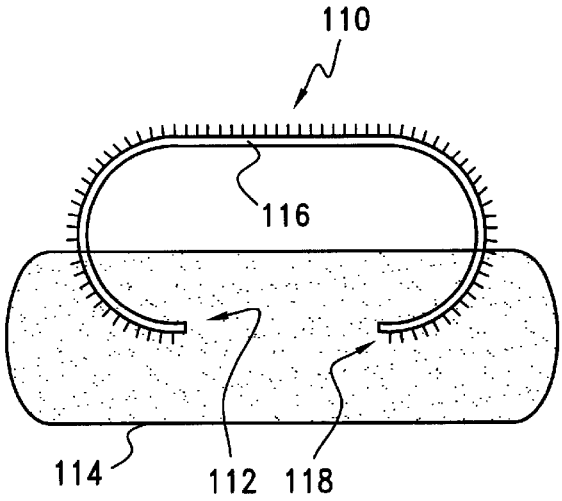
FIG. 2 is a side cross sectional view of a second embodiment of the invention.

As seen in FIG. 2, in a second embodiment of the invention, first end 112 and second end 118 of strip 110 of hook and loop material are both embedded within body 114. Strip 110 has an exposed center section 116 located between first and second ends 112, 118. Center section 116 is spaced apart from body 114, so that strip 110 serves as a handle as well as providing a tether.

Figure 3:
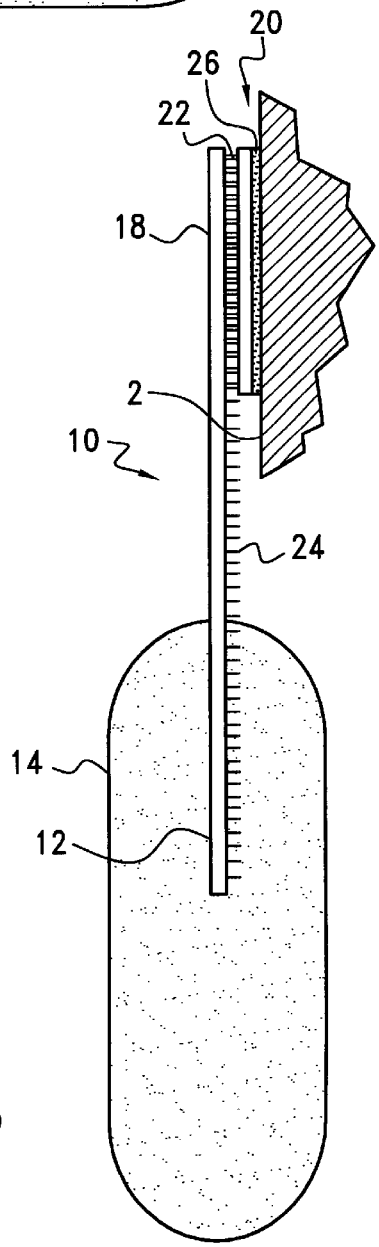
FIG. 3 is an environmental, side cross sectional view of an embodiment of the invention.

The tether function is illustrated in FIG. 3, wherein body 14 is suspended from an environmental surface 2 by an anchoring member 20. Anchoring member 20 comprises a strip of material having a broad surface or face bearing complementary hook and loop material 22 which mates with the hook and loop material 24 of strip 10. It does not matter which member bears hooks and which bears loops. The other side of anchoring member has a broad surface or face corresponding to that bearing hook and loop material 22. The corresponding face bears adhesive 26 of any suitable well known type, for mounting anchoring member 20 permanently on environmental surface 2.

Figure 4:
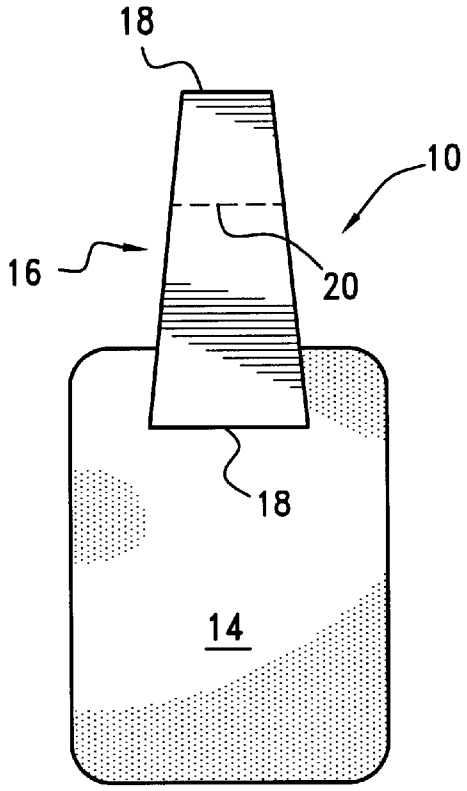
FIG. 4 is a top plan cross sectional view of an embodiment of the invention.
Figure 5:
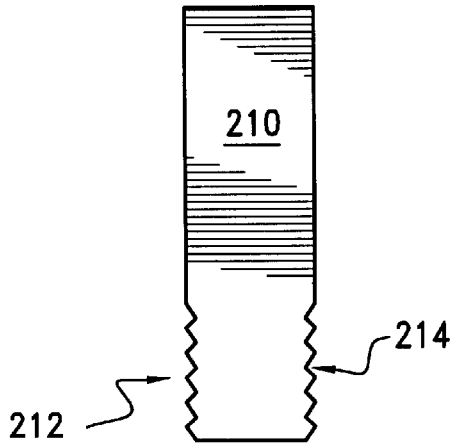
FIG. 5 is a top plan detail view of an alternative embodiment of a member corresponding to that shown at the top of FIG. 4.

Body 14 or 114, strip 10 or 110, and anchoring member 20 can have different functional and esthetic features. For example, in the embodiment of FIG. 1, strip 10 has serpentine configuration to improve attachment of strip 10 to body 14. This may be accomplished in other ways both instead of and in addition to serpentine configuration of strip 10. In FIG. 5, strip 210 of hook and loop fastening material has pinked edges 212, 214. Edges 212, 214 are formed on that end of strip 210 which will subsequently be embedded within a body (not shown). Of course, if both ends of strip 210 are to be embedded as shown in FIG. 2, then both ends would be pinked. In FIG. 4, strip 10 is seen to be relatively wide at first end 12 relatively narrow at second end 18.

Still another characteristic shown in FIG. 4 is that one end of body 14 has a characteristic silhouette or other configuration, and that anchoring member 20 has a similar geometric or silhouette or configuration where strip 10 overlies anchoring member 20.

Body 14 or 114 in the various embodiments has been presented as a parallelepiped having rounded edges. Body 14 or 114 can, if desired, take other forms (not shown). For example, body 14 or 114 can simulate an animal or a fictitious character, or may assume any other recognizable configuration. Similarly, anchoring member 20 can be formed to have the same silhouette as body 14 or 114, or alternatively, other recognizable attributes of an alphanumeric or other symbol, a logo, an animal, a fictitious character, or any other symbolic or esthetic configuration.

Figure 6:
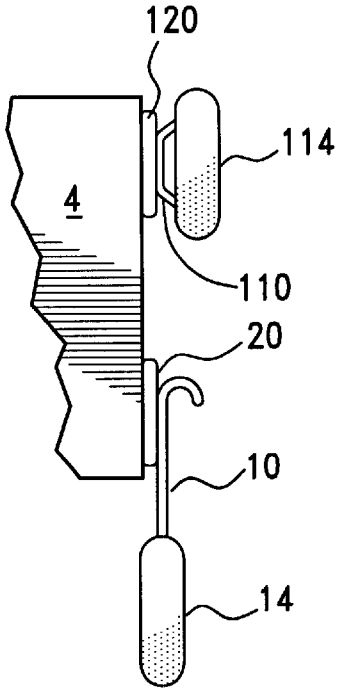
FIG. 6 is an environmental view illustrating supporting articles from a vertical environmental surface utilizing embedded hook and loop fastener.

FIG. 6 illustrates how the embodiments of FIGS. 1 and 2 may be supported from the vertical surface 4 of an environmental object such as a sink or countertop (neither shown in its entirety). Body 114 can be supported above body 14 even if height of surface 4 is limited. Strip 110 removably attaches to anchoring member 120 which has hook and loop material matingly compatible with that of strip 110.

Figure 7:
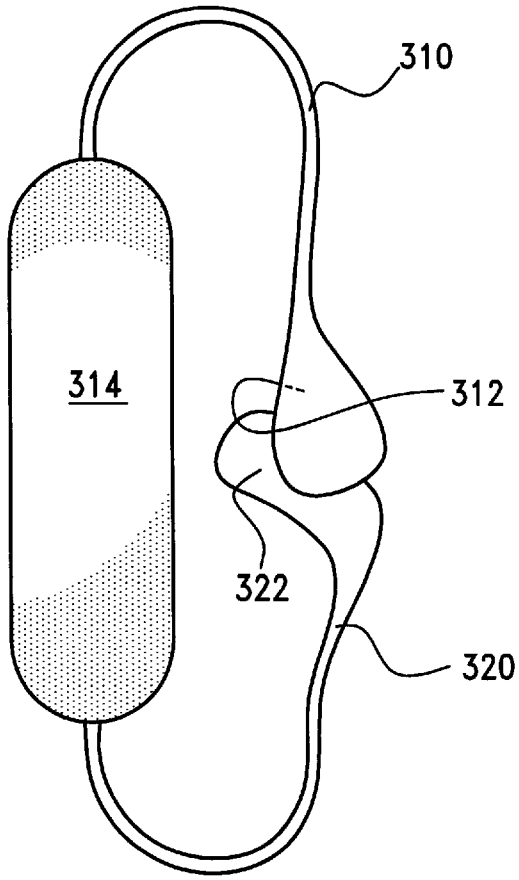
FIG. 7 is a side elevational view of an alternative embodiment of the invention incorporating two embedded strips of hook and loop material.

FIG. 7 illustrates a second embodiment of the invention wherein body 314 has a first strip 310 bearing hook fastening material 312 and a second strip 320 bearing loop fastening material 322. Strips 310, 320 each have one end embedded within body 314 and a free end. Body 314 may be securely fixed to surface 4, as shown in FIG. 8.

Figure 8:
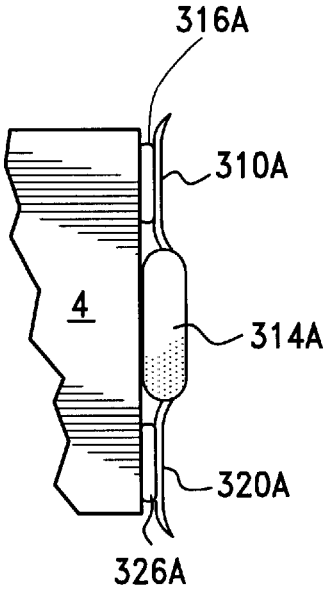
FIG. 8 is an environmental view showing a further alternative embodiment of the invention, supported from a vertical environmental surface.

In the embodiment of FIG. 8, body 314A may for example comprise an edible treat or nutrient such as vitamins and minerals for an animal to lick. In the arrangement of FIG. 8, there is only one strip of hook and loop material passing entirely through body 314A and projecting therefrom at two free ends 310A, 320A. End 310A attaches to one anchoring member 316A and end 320A attaches to a second anchoring member 326A such that body 314A can withstand being licked without being dislodged from its mounting on surface 4. Anchoring members 316A, 326A are similar to anchoring member 120 of FIG. 3 in that each anchoring member 316A or 326A has a first broad face bearing hook and loop material which is complementary to that of its associated end 310A or 320A, and an opposed broad face bearing adhesive.

Figure 9:
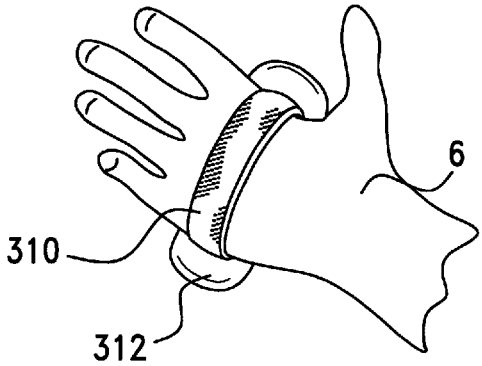
FIG. 9 is an environmental view showing the embodiment of FIG. 7 worn on a person's hand.

In another form of mounting shown in FIG. 9, strips 310, 320 are sufficiently long as to be able to overlap to fasten to one another while leaving enough space to insert a person's hand 6 into the closed loop formed when strips 310, 320 overlap and are closed over hand 6.

Figure 10:
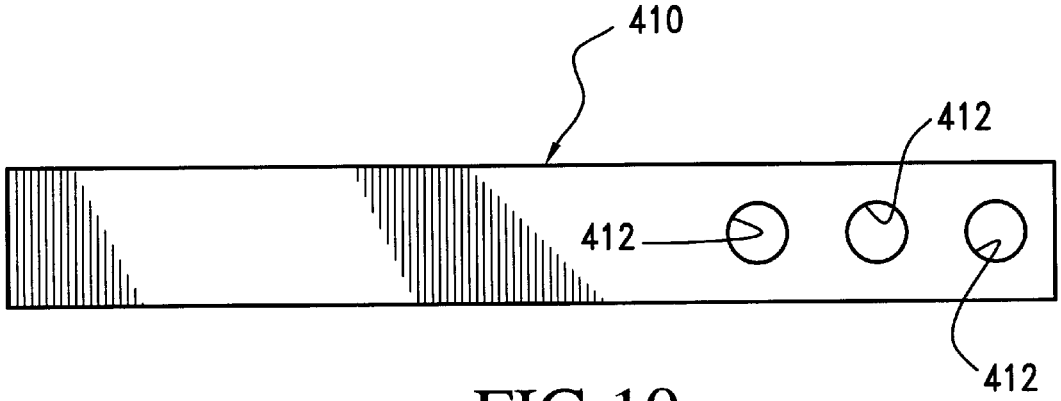
FIG. 10 is a top plan detail view of an alternative embodiment of a strip of hook and loop material.

FIG. 10 shows an alternative form of a strip 410 of hook and loop material wherein holes 412 are formed therein. Holes 412 may be utilized to increase secure anchorage of strip 410 within an associated body of consumable material (not shown in this view). Alternatively, holes 412 may be used to enable suspending the associated body from a hook (not shown) as a supplementary way of supporting the associated body.

A method of forming an article generally similar to that depicted in FIG. 1 comprises the steps of providing an open mold, suspending a strip of hook and loop material above the open mold such that at least one end of the strip of hook and loop material is below the upper surface of the open mold, casting constituent material in fluent form over at least one end of a strip of hook and loop material, and allowing the constituent material to harden into solid form with the strip of hook and loop material projecting from hardened constituent material. The method set forth above can be easily modified to produce the embodiment of FIG. 2. The step of casting constituent material in fluent form comprises the further step of casting constituent material in fluent form over both ends of the strip of hook and loop material, and leaving the center of the strip of hook and loop material out of contact with cast constituent material.

For forming solid bars or cakes of soap, either method is modified such that the step of casting constituent material in fluent form comprises the further step of casting soap in fluent form. Either method may further be modified to include steps of causing the strip of hook and loop material to assume serpentine configuration, to be wider at the embedded end than at an exposed end, and of pinking edges of the strip of hook and loop material.

The invention is susceptible to additional variations and modifications which may be introduced thereto without departing from the inventive concept. For example, strip 10, 110, or 210 may have a pressure sensitive adhesive backing. Strip 10, 110, or 210 may be die cut to assume an ornate configuration altering the silhouette or including openings. Solid body 14 or 114 may have indentations, openings, passages, and may further have inclusions of substances other than the major constituent material. Strip 10, 110, or 210 may have its central portion embedded, with two exposed ends projecting from body 14 or 114. Strip 410 may be modified to include holes 412 at both ends or only in the center portion of strip 410 if desired.

It is to be understood that the present invention is not limited to the embodiments described above, but encompasses any and all embodiments within the scope of the following claims.

I claim:

1. An article having a projecting fastener, comprising a first strip of hook and loop fastening material having a first end and a second end, and a body formed from constituent material cast over said first end of said hook and loop fastening material, wherein said first strip of hook and loop material has an embedded portion and a first exposed portion spaced apart from said body, further wherein embedment of said first strip of hook and loop material provides secure attachment of said hook and loop fastening material to said body formed of constituent material.

2. The article according to claim 1, wherein said constituent material is of a type which is progressively depleted with routine use.

3. The article according to claim 1, wherein said constituent material is solid soap.

4. The article according to claim 1, wherein said first strip of hook and loop fastening material is longitudinally aligned with said body.

5. The article according to claim 1, wherein said first end of said first strip of hook and loop fastening material is embedded within said constituent material, and said second end of said hook and loop material is exposed.

6. The article according to claim 1, wherein said first end and said second end are both embedded within said body, and said first strip of hook and loop material has a center section located between said first end and said second end, wherein said center section is exposed and spaced apart from said body.

7. The article according to claim 1, wherein said first strip of hook and loop fastening material has pinked notch edges.

8. The article according to claim 1, wherein said first end of said first strip is relatively wide and said second end of s aid first strip is relatively narrow.

9. The article according to claim 1, wherein that portion of said first strip which is embedded within said body has serpentine configuration relative to said body.

10. The article according to claim 1, further including an anchoring member having a first broad face bearing complementary hook and loop material and an opposed broad face bearing adhesive.

11. The article according to claim 10, wherein said anchoring member has a silhouette and said body has a geometrically similar silhouette.

12. The article according to claim 1, further including a second strip of hook and loop fastening material having a first end embedded within said body and a free second end.

13. The article according to claim 12, wherein said first strip of hook and loop material bears hook fastening material and said second strip of hook and loop material bears loop fastening material.

14. The article according to claim 13, wherein said second end of said first strip of hook and loop material is free, and is sufficiently long as to overlap said second strip of hook and loop material, thereby forming a loop capable of closing over a hand of a person, and being removably attachable thereover.

15. The article according to claim 12, further including an anchoring member having a first broad face bearing complementary hook and loop material and an opposed broad face bearing adhesive.

16. The article according to claim 1, wherein said first strip of hook and loop fastening material has at least one hole formed therein.

17. The article according to claim 1, wherein said first strip of hook and loop fastening material further has a second exposed portion spaced apart from said body, wherein said second portion is located away from said first exposed portion.

* * * * *